United States Patent [19]

Elliott et al.

[11] Patent Number: 4,531,593

[45] Date of Patent: Jul. 30, 1985

[54] SUBSTANTIALLY SELF-POWERED FLUID TURBINES

[76] Inventors: Guy R. B. Elliott, 133 La Senda Rd., Los Alamos, N. Mex. 87544; Milton W. McDaniel, P.O. Box 488, Cimarron, N. Mex. 87714; Barton L. Houseman, 17 Galloway Ave., Cockeysville, Md. 21030

[21] Appl. No.: 474,356

[22] Filed: Mar. 11, 1983

[51] Int. Cl.[3] ..... E21B 4/00; E21B 7/00

[52] U.S. Cl. ..... 175/71; 175/93; 166/370; 166/105

[58] Field of Search ..... 175/93, 71; 166/370, 166/305 D, 105; 60/641.2, 641.4

[56] References Cited

U.S. PATENT DOCUMENTS

| | | | |
|---|---|---|---|
| 2,662,486 | 12/1953 | Hillger | 166/105 |
| 4,194,567 | 3/1980 | Marais | 175/71 |
| 4,235,289 | 11/1980 | Weeter | 166/62 |
| 4,248,305 | 2/1981 | Scarbrough et al. | 166/370 |
| 4,377,208 | 3/1983 | Elliott et al. | 166/370 |
| 4,378,047 | 3/1983 | Elliott et al. | 166/68 |
| 4,434,862 | 3/1984 | Lyons | 175/71 X |

*Primary Examiner*—James A. Leppink
*Assistant Examiner*—Hoang C. Dang

[57] ABSTRACT

A method is provided for substantially self-powering turbines by expanding compressed gases released downhole or in adjacent formations. These gases do work in the turbines as the gases expand toward atmospheric pressure at the earth's surface. The method offers alternative and supplemental approaches to recovering hydrocarbon gases, water vapor, carbon dioxide, other gases, and petroleum from watered out wells and from deep or hot wells.

2 Claims, 6 Drawing Figures

SUBSTANTIALLY SELF-POWERED FLUID TURBINES

BACKGROUND OF THE INVENTION

This invention relates generally to a method of downhole turbine operation in which substantial amounts of the power needed for the turbine operations are supplied from in situ forces. Because the supply of power for downhole operations from surface power sources is both difficult and expensive, significant economic benefits will be expected to derive from the use of the said in situ forces. The forces to be used arise from gases which can be released from fluids surrounding a well—such released gases can be expanded as they flow toward lower pressures at the earth's surface, and such expansion can be made to do useful work.

Brines and petroleum at high pressures are known to dissolve substantial amounts of valuable gases; for examples, hydrocarbon gases (e.g., methane, the principal component of natural gas) and carbon dioxide (a gas with numerous uses such as for dry ice or for tertiary recovery of petroleum) are frequently present in commercially valuable quantities around wells in oil and gas fields. Such dissolved gas can be substantially released from high-pressure solution by reducing the pressure above brine or petroleum, and if the brine or petroleum is brought to the surface the dissolved gases usuallly are recovered. However, commercially practical means to circulate fluids underground so that their dissolved gases can be recovered in a well by pressure reduction usually are not available with current technology; a major obstacle to suitability of technology has been the expense and difficulty of supplying surface power to underground uses, expenses and difficulties which could be circumvented by devices applying the methods of the present invention.

Similarly, brine at elevated pressures and temperatures can release steam if the pressure is reduced over the brine. If such brine could be circulated from a deep, hot formation, into a well where the pressure could be reduced, and back into a disposal formation, then steam could be released from the brine and be delivered to the surface. Such steam would be a valuable source of fresh water as well as a source of heat.

Likewise, brines or petroleum in natural formations underground may entrap bubbles of gas comprising methane, other hydrocarbons, carbon dioxide, or combinations of these and other gases. Such natural entrapment may be substantially increased by man's actions, particularly when hydrocarbons are commercially produced from wells. Here intruding brine may trap droplets of petroleum or bubbles of gas; temperature changes during gas production may result in gas condensation and entrapment in gas wells; or too large pressure gradients may produce channeling which bypasses materials which one would like to recover. As a consequence, wells which have watered out to uselessness often still contain as much as half of their original hydrocarbon content. Self-powered means to circulate more brine through the formations just discussed would offer the possibility of recovering considerably more of the entrapped hydrocarbons. Such self-powering is offered by the present invention.

Self-powering by in situ forces is claimed in prior art by Elliott, et al., U.S. Pat. No 4,262,747, issued Apr. 21, 1981. In that patent, for example, gas lift is used to raise brine into a standpipe, and the head of the standpipe is used to force the reinjection of brine from which the dissolved natural gas has been removed, thereby downhole accomplishing brine circulation and gas removal by downhole forces. However, this and all other prior art has failed to identify certain novel uses of already commercialized pumps called centrifugal pumps or turbine pumps by their manufacturers; these novel uses are described further in the next paragraph and are the subject of the present patent. Further use of downhole forces to power pumps is claimed in patents, not yet issued, by Elliott, et al., (U.S. Pat. No. 4,376,462 to issue Mar. 15, 1983, and No. 4,377,208 to issue Mar. 22, 1983), but these patents also fail to identify the novel use of centrifugal pumps or turbine pumps as follows.

"Centrifugal turbines" is the phrase we will use instead of centrifugal pumps or turbine pumps because, under the present invention, the devices are used both as substantially self-powered motors and as conventional pumps. These centrifugal turbines are here used in a novel and unobvious way as downhole motors powered by the expansion of gas in gas-liquid mixtures as these mixtures move toward lower pressures. These lower pressures toward which the gas expands will usually be established by a gas path toward lower pressures at the earth's surface; substantially pure, spent brine (i.e., brine with its gas largely removed and without important amounts of petroleum droplets) will usually be pumped into a disposal formation without ever moving to the earth's surface; petroleum, or petroleum-water mixtures which do not separate readily, will usually be pumped to the earth's surface for recovery. Centrifugal turbines are especially useful for motor operations such as these in which expanding gas imparts velocity, momentum, and kinetic energy to liquids in gas-liquid mixtures—specifically, the design of the stages of gas-liquid turbines allows substantially continuous flow through a series of these stages, and, as the stage pressures are lower (i.e., are closer to atmospheric pressure), the velocities of the liquid become larger and larger and the kinetic energies available to the motor to allow it to do work also increase, with the square of the velocity. As compared with most other types of pumps used downhole, centrifugal turbines are particularly well suited for motor operation as just described. Note, however, that centrifugal turbines and other downhole pumps were designed for use as pumps, not as motors: All downhole pumps being built commercially are designed to be powered from the earth's surface.

Because centrifugal turbines can be worked before gas-liquid separation, they can be made to do work at all pressures from high formation pressures to near atmospheric pressures—this large operating range is a great advantage for downhole-motor use.

Gas turbines, like centrifugal turbines, have the advantage that they can accommodate some liquid, and their use is claimed along with centrifugal turbines under the present invention. However, gas turbines will normally be used only after gas-liquid separation. Therefore, in a practical sense, these gas turbines cannot be worked at high formation pressures.

SUMMARY OF THE INVENTION

An object of this invention is a substantially self-powered method of powering turbines in a well based on expansion of gases released downhole or in adjacent formations.

Further objects of this invention are the use of centrifugal turbines and gas turbines as substantially self-powered turbines.

Still further objects of this invention are the uses of hydrocarbons, carbon dioxide, water vapor, and combinations of these and other gases as gases to be expanded to power substantially self-powered turbines.

Still further objects of this invention are the recoveries of hydrocarbons, carbon dioxide, and water vapor in commercially useful quantities; likewise, in some other cases other commercially useful gases may be recoverable.

Still further objects of this invention are the substantially self-powered circulations of brine or of petroleum or of both from formations, such circulations being important to recovery of gases associated with brine or petroleum as well as to recovery of petroleum, itself.

Still further objects of this invention are the use of centrifugal turbines and gas turbines as motors for powering centrifugal pumps or electric generators.

Still further objects of this invention are methods of supplying gas from the earth's surface to downhole pumps to augment or replace their self-powered features.

Additional objects, advantages, and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purpose of the present invention, as embodied and broadly described herein, the method of this invention comprises:

(a) inserting at least one well into at least one formation such that fluids from the said formation can flow into the said well,
(b) emplacing at least one turbine in the said well,
(c) providing at least one conduit means by which gas substantially at or below formation pressures can flow from the said turbine to lower pressures substantially at the earth's surface,
(d) providing at least one additional conduit means through which liquids can flow to be discharged,
(e) providing means for substantially separating gases and liquids,
(f) flowing fluid from the said formation and to the said well,
(g) flowing gas from the well, through the said turbine, and through the said one conduit means and substantially to the earth's surface,
(h) flowing liquid from the said well and through the said additional conduit means to discharge, and
(i) powering the said turbine at least in part by the expansion of the said gas.

In a preferred embodiment, gassy brine containing dissolved gas and bubbles flows from a watered out stratum which originally held a cap of natural gas, then the brine moves into a well where the gases are removed, and finally the degassed brine is pumped out to a highly permeable stratum suitable for spent-brine disposal. Meanwhile, the gases removed from the brine power a centrifugal turbine which drives the spent-brine pump as the gases move from downhole pressures to near-atmospheric pressure above ground.

In another embodiment, gassy brine moves from its formation, through a choke, and into a lower-pressure region where the gas is removed at a pressure low compared to formation pressure but high compared to atmospheric pressure. Separated gas then flows through at least one gas turbine which acts as a motor to drive a spent-brine pump which circulates brine out of the well and to a disposal formation.

In another preferred embodiment, a centrifugal turbine acts as a substantially self-powered motor to power flushing of dissolved gas, bubbles, and petroleum droplets into a well where gases and liquids are separated—gas flows to the surface for recovery, petroleum floats on the brine and is pumped by use of surface power to deliver it to the surface for recovery, and spent brine is pumped into a disposal formation.

In another embodiment, an electric generator is connected to a self-powered motor, in this case a downhole gas turbine.

In another preferred embodiment, supplemental power for operating a centrifugal turbine is supplied by pumping a volatile liquid from the surface and into the centrifugal turbine.

By the practice of this invention, it is expected that gaseous hydrocarbons, carbon dioxide, water vapor, other gases, and petroleum can economically be recovered from formations which are not economically productive by current technology. In particular, watered out gas and oil wells, deep wells into brine containing at least 15 SCF of dissolved natural gas per barrel of brine, and hot brines in porous formations are expected to become productive through use of this invention. Such wells are available widely in the U.S.A. and throughout the world.

BRIEF DESCRIPTION OF THE DRAWINGS

The accompanying drawings, which are incorporated in and form a part of the specification, illustrate various embodiments of the present invention and, together with the description, serve to explain the principles of the invention. In the drawings.

DESCRIPTION OF THE PREFERRED EMBODIMENTS

In the following, self-powered is defined to mean powered by the expansion of gases derived from fluids naturally present in underground formations. Likewise, the phrase centrifugal turbine is defined to mean devices commonly called centrifugal pumps or turbine pumps when such pumps are used as motors which are at least partially self powered.

Figure 1:
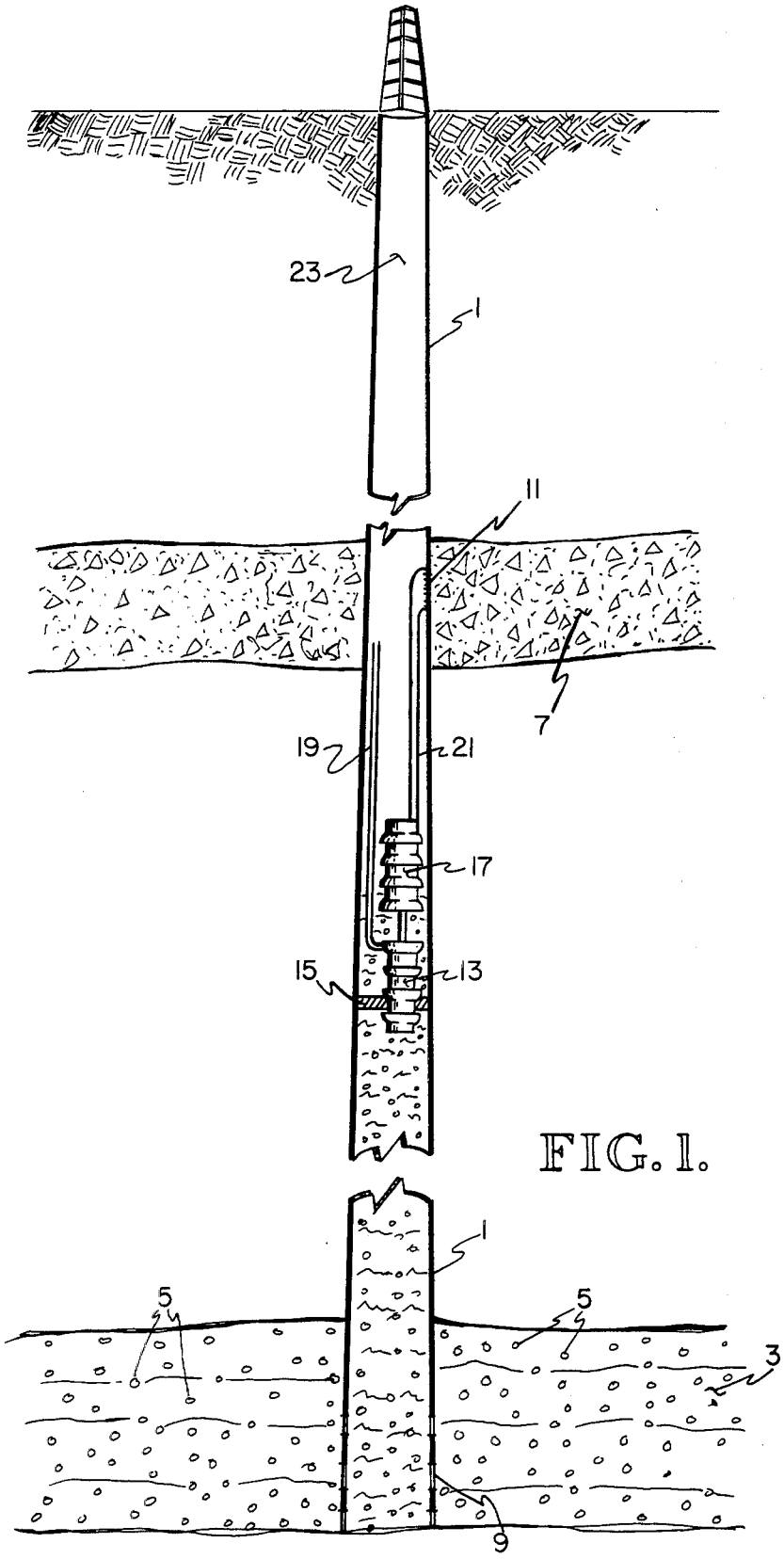
FIG. 1 is a schematic illustration in cross section of an embodiment of the method of the invention in which gassy brine containing dissolved gas and bubbles flows from a watered out stratum which originally held a cap of gas and into a well where a substantially self-powered centrifugal turbine drives brine circulation and gas recovery with the brine being reinjected without first moving to the surface.

Referring to the drawing, in FIG. 1 a well 1 has been drilled into a gassy formation 3 found at a depth of approximately 8000 feet. This formation 3 has had its gas cap produced until brine has watered out the well and trapped gas bubbles 5. This well has been cased (not shown), but such casing is not always necessary. The well also penetrates a highly permeable formation 7 which is suitable for disposal of spent brine. The well 1 is perforated to produce gassy-brine perforations 9 and spent-brine perforations 11. A centrifugal turbine 13 is held in place by a packer 15, and the centrifugal turbine 13 is attached to a centrifugal pump 17. Operations of the centrifugal turbine and the centrifugal pump are discussed during discussion of FIG. 2. The discharge of the centrifugal turbine 13 moves along turbine tubing 19 while that of the centrifugal pump 17 moves along pump tubing 21 and out through spent-brine perforations 11 to the highly-permeable formation 7. Separated gas 23 moves up the well 1 to surface recovery.

Figure 2:
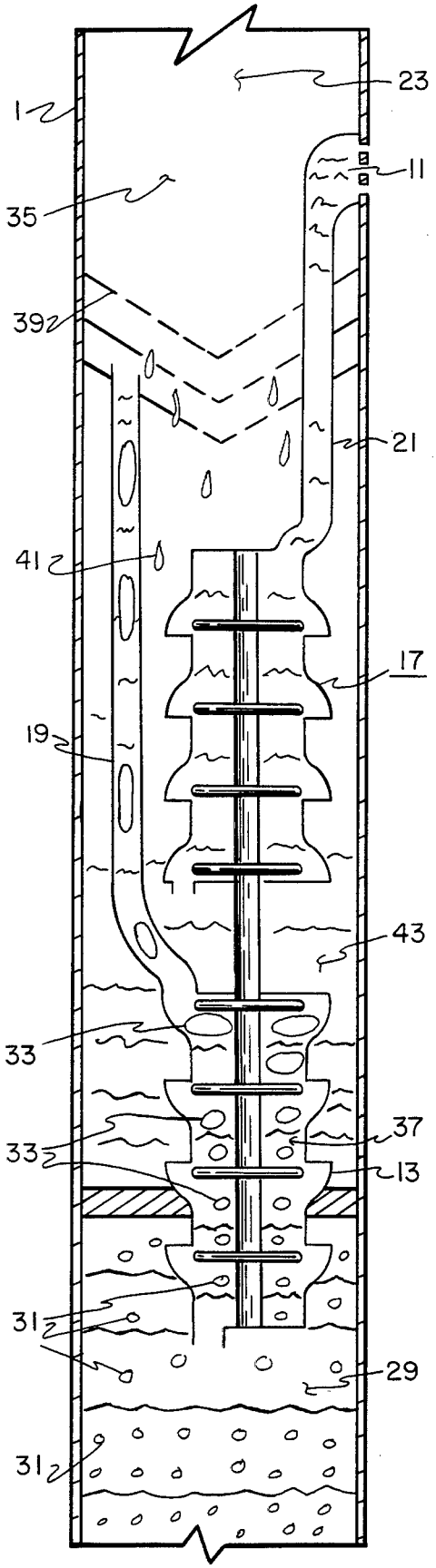
FIG. 2 is a schematic illustration in cross section of an embodiment of the method of the invention as shown in FIG. 1 but enlarging and clarifying the motor, pump, and gas-liquid-separations sections.

In FIG. 2, which explains FIG. 1 in more detail, gassy brine 29 from gassy formation 3 in FIG. 1 moves into the bottom of centrifugal turbine 13 where gas bubbles 31 become expanding gas bubbles 33 as they move toward a region of lower pressure 35 in the well 1. The well 1 also serves as a conduit to the surface for the separated gas 23. The expanding gas bubbles 33 impart momentum to their associated brine 37, and this imparted momentum in the associated brine 37 can be used to do work over that which would be associated with simple, gas-free flow of the brine through the centrifugal turbine 13 and to the region of lower pressure 35.

The expanded gases 33, and their associated brine 37 discharge to a gas-liquid separator 39 (not shown in FIG. 1) where spent brine 41 returns to a spent-brine reservoir 43 which supplies a centrifugal pump 17 which is driven by the centrifugal turbine 13 and which pumps spent brine from the spent-brine reservoir 43 through tubing 21 , out spent-brine perforations 11 and into the highly permeable formation 7 shown in FIG. 1.

The level of performance anticipated from the method of FIGS. 1 and 2 can be indicated by the following analysis: A TRW Reda centrifugal pump, 562 series, 100 stage, H350, driven with 640 HP at 3500 RPM, operates to yield 4000 feet of head and 14,000 barrels of brine per day and fits in a 7-inch OD 23 lb casing, according to Reda's performance data. If a similar 50-stage centrifugal turbine and 50-stage centrifugal pump operated to pump brine carrying 10% by volume of natural-gas bubbles from an 8000-ft source, the flow would deliver 2.7 million SCF of gas per day to the well. The centrifugal turbine could be placed to inject spent brine at the 4000-ft level using a 2000-ft head. The gas expansion, plus the coupled brine decompression and brine recompression for reinjection, together can supply more than enough work to drive the brine circulation. If 50% of the gas were actually recovered and sold at $2.50 per MCF, the annual sales would be over $1 million for about $0.5 million in pump construction, workover, and operating costs.

Figure 3:
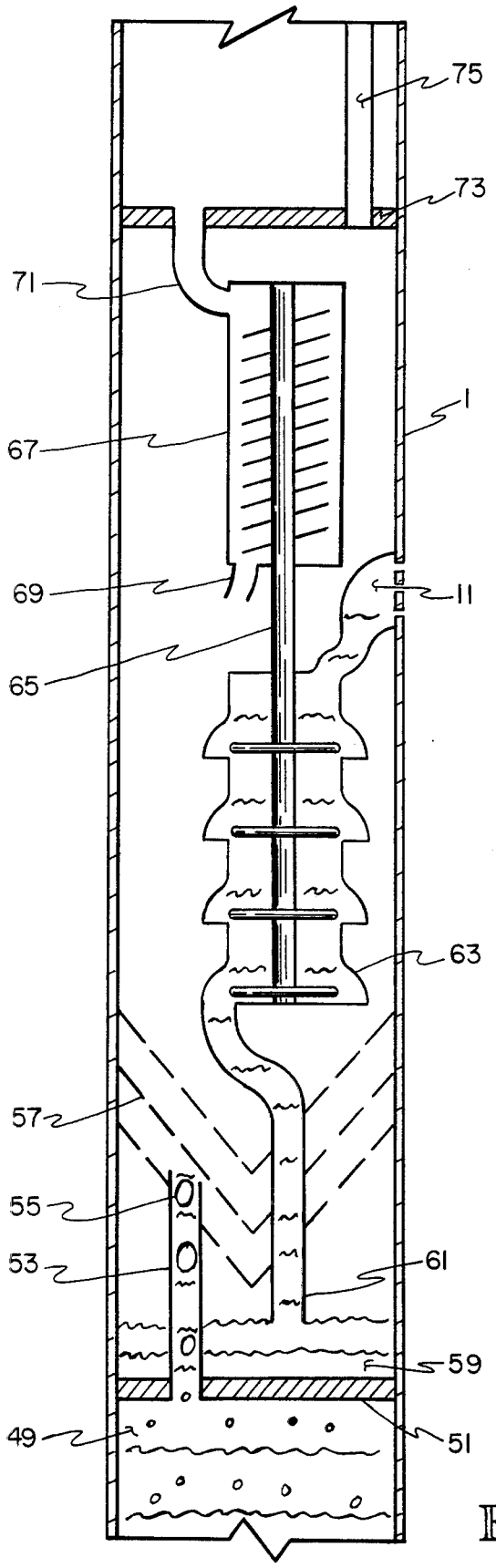
FIG. 3 is a schematic illustration in cross section of an embodiment of the method of the invention in which gassy brine moves from its formation, through a choke, and into a lower-pressure region where the gas is removed and operates a gas turbine which acts as a motor to drive a spent-brine-injection pump.

FIG. 3 represents a different type of substantially self-powered motor placed in the well 1 of FIG. 1 with its gassy formation 3, gassy brine perforations 9, highly permeable formation 7, and spent-brine perforations 11. In FIG. 3 gassy brine 49 moves up to a lower packer 51 and into a gassy-brine inlet 53. The gassy-brine inlet 53 serves also as a choke which drops the pressure locally on the gassy brine and expands the gas bubbles 55. Gas bubbles and brine move to a gas-liquid separator 57 from which gas moves up and spent brine 59 collects above the lower packer 51. Spent brine is drawn up through a spent-brine-feed conduit 61 to a centrifugal pump 63 which pumps brine out of the spent-brine perforations 11 and into the highly permeable formation 7. A common shaft 65 connects the centrifugal pump to a gas turbine 67 which serves as a motor to drive the centrifugal pump 63. Gas from the gas-liquid separator 57 moves through a gas-turbine entry port 69, through the gas turbine 67, and out a gas-turbine exit port 71. An upper packer 73 seals the well 1 to the the gas-turbine exit port 71 and to a surface-gas feed tube 75. The gas turbine 67 is driven by a combination of gas supplies, i.e., gas supplied from the gas-liquid separator 57 and from the surface-gas feed tube 75. Feeding gas from the surface-gas feed tube allows the self-powering features of the invention to be augmented by surface power. Gas which has passed the gas-turbine exit port 71 moves up the well 1 to the surface and recovery facilities.

Figure 4:
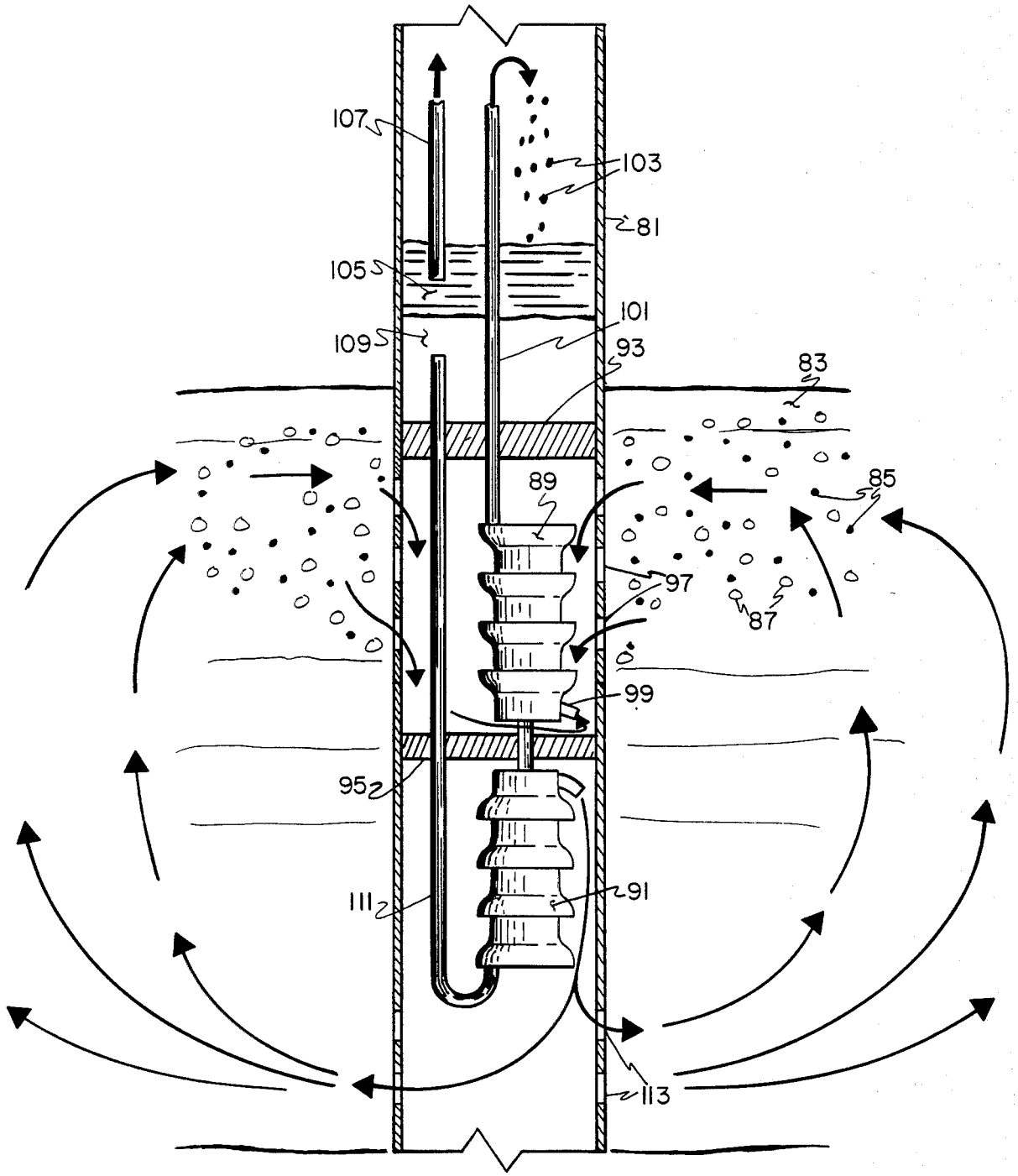
FIG. 4 is a schematic illustration in cross section of an embodiment of the method of the invention in which a centrifugal turbine acts as a substantially self-powered motor to power flushing of dissolved gas, bubbles, and petroleum droplets into a well where they can be separated and recovered with the spent brine being returned to a different section of its original formation.

In FIG. 4, a well 81 has been placed into a petroleum-bearing formation 83 and petroleum has been produced by primary and secondary means including water flooding. Now the petroleum-bearing formation 83 contains bypassed droplets of petroleum 85 and gas bubbles 87 along with brine. As a means of tertiary petroleum recovery, a centrifugal turbine 89 and a connected centrifugal pump 91 have been set with upper packer 93 and lower packer 95. Oily, gassy brine swept from the petroleum-bearing formation 83 moves through the upper perforations 97, through the turbine entry port 99, and into the centrifugal turbine 89 where the gas expands and does work. The worked oily,gassy brine moves up and out of the oil-gas-brine discharge tube 101 after which the gas moves up the well 81 to recovery, and brine and oil droplets 103 fall into a reservoir formed by the well 81 and the upper packer 93. Extracted oil is recovered by pumping collected oil 105 by surface power to the surface through oil-recovery tube 107. Separated brine 109 is returned to the lower portion of the petroleum-bearing formation 83 by pumping from the said reservoir, through a spent-brine feed tube 111, and out lower perforations 113.

Figure 5:
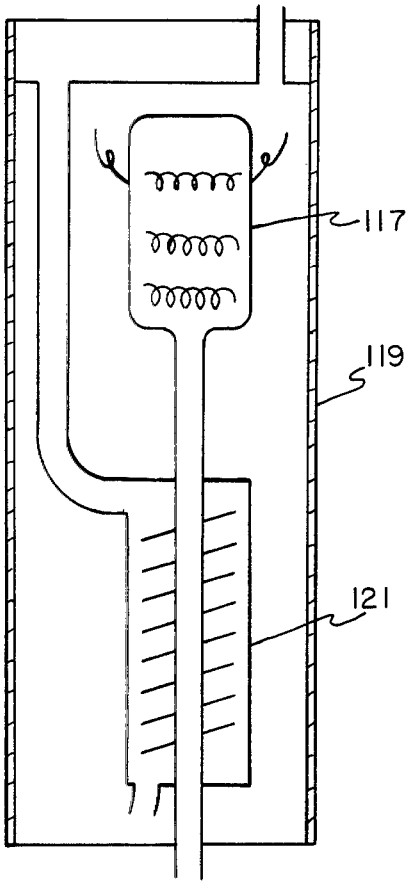
FIG. 5 shows attachment of an electric generator to a downhole gas turbine which acts as a self-powered motor.

In FIG. 5, an electric generator 117 in a well 119 is shown connected to a gas turbine 121 which acts as a motor to drive the electric generator 117 using self-powering forces downhole.

Figure 6:
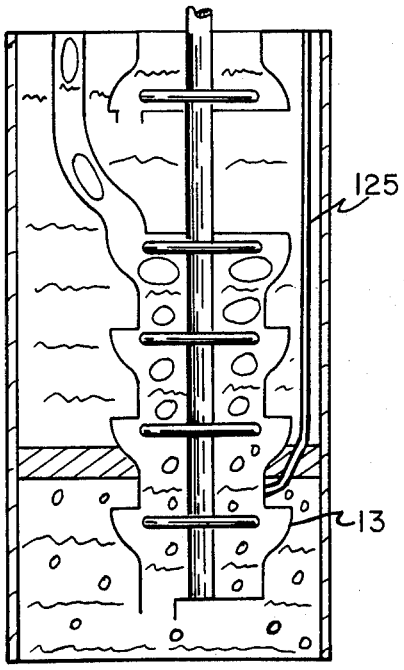
FIG. 6 shows supplemental power for operating a centrifugal turbine being supplied from the surface by pumping a volatile liquid into the centrifugal turbine.

In FIG. 6, a gas feeder 125 connected to surface facilities has been connected to the centrifugal turbine 13 in FIG. 2. This gas feeder 125 permits the addition of gases or volatile liquids to the centrifugal turbine 13, thereby augmenting the downhole self powering; in effect, this kind of addition uses surface power to supplement the power available downhole.

What is claimed is:

1. A substantially self-powered method of recovering watered out natural gas comprising:

(a) providing at least one well into at least one formation containing the said watered out natural gas such that fluids from the said formation can flow into the said well, (b) emplacing at least one centrifugal turbine in the said well, (c) providing at least one conduit through which gas substantially at or below formation pressures can flow from the said centrifugal turbine to lower pressures substantially at the earth's surface, (d) providing at least one additional conduit through which liquids can flow to be discharged, (e) providing means for substantially separating natural gas and brine, (f) flowing fluid from the said formation and to the said centrifugal turbine in the said well, (g) expanding the said fluid in the said centrifugal turbine, thereby providing self-powering, (h) separating the said expanded fluid into released natural gas and spent brine, (i) flowing the said released natural gas from the well, through the said one conduit and substantially to the earth's surface, (j) flowing the said spent brine from the said well and through the said additional conduit means to discharge, and (k) allowing brine circulation in formations adjacent to the well corollary to brine flow into and out of the well.

2. A substantially self-powered method of releasing and recovering droplets of petroleum and natural gas from oily, gassy brine in petroleum-bearing formations comprising:

(a) providing at least one well into at least one briny formation containing the said oily, gassy brine such that the said oily, gassy brine from the said formation can flow into the said well, (b) emplacing at least one centrifugal turbine in the said well, (c) providing at least a first conduit means through which gas substantially at or below formation pressures can flow from the said centrifugal turbine to lower pressures substantially at the earth's surface, (d) providing at least a second conduit through which substantially oil-free, substantially gas-free brine can flow to be discharged, (e) providing at least a third conduit through which petroleum can be pumped for recovery, (f) providing means for substantially separating gases and liquids, (g) flowing oily, gassy brine from the said formation and to the said centrifugal turbine in the said well, (h) expanding the said oily, gassy brine in the said centrifugal turbine, thereby providing self powering, (i) separating the said oily, gassy brine into fractions comprising separated petroleum, released natural gas, and spent brine, (j) flowing released natural gas through said one conduit means and substantially to the earth's surface, (k) pumping spent brine from the said well and through the said additional conduit means to discharge, (l) pumping petroleum substantially to the earth's surface, and (m) allowing brine circulation in formations adjacent to the well corollary to brine flow into and out of the well.

* * * * *